United States Patent [19]

Wojtanek

[11] Patent Number: 4,683,359

[45] Date of Patent: Jul. 28, 1987

[54] ILLUMINATED SWITCH ASSEMBLY WITH COMBINED LIGHT AND LIGHT SHIELD

[75] Inventor: Guy A. Wojtanek, Franklin Park, Ill.

[73] Assignee: Eaton Corporation, Cleveland, Ohio

[21] Appl. No.: 839,239

[22] Filed: Mar. 13, 1986

[51] Int. Cl.[4] ..... H01H 9/18

[52] U.S. Cl. ..... 200/314; 200/310

[58] Field of Search ..... 200/312, 314, 317; 250/463.1, 465.1, 466.1; 340/781, 815.13

[56] References Cited

U.S. PATENT DOCUMENTS

| | | | |
|---|---|---|---|
| 2,904,662 | 9/1959 | Spring | 200/314 |
| 3,163,739 | 12/1964 | Hutt | 200/314 |
| 3,482,542 | 12/1969 | Mace | 116/202 |
| 4,060,703 | 11/1977 | Everett, Jr. | 200/5 A |
| 4,320,268 | 3/1982 | Brown | 200/314 |
| 4,359,618 | 11/1982 | Stevens | 200/314 |
| 4,549,050 | 10/1985 | Lang | 200/314 |

FOREIGN PATENT DOCUMENTS

| | | | |
|---|---|---|---|
| 2066575 | 7/1981 | United Kingdom | 200/317 |

*Primary Examiner*—Stephan Marcus
*Assistant Examiner*—Renee S. Luebke
*Attorney, Agent, or Firm*—D. A. Rowe; R. A. Johnston

[57] ABSTRACT

A switch assembly having a pushbutton actuator with graphics backlit by an electroluminescent light source deposited upon a mylar substrate. A separate indicator lamp is provided to be lit when the function selected by the switch is activated. The indicator light is visible through a small window in the pushbutton. In order to prevent light from the indicator lamp from impinging upon the graphics area, a portion of the mylar substrate is opaquely coated to block the light transmission, while the remainder of the mylar substrate is clear to insure proper registration and prevent degradation of the electroluminescent phosphor.

2 Claims, 5 Drawing Figures

ILLUMINATED SWITCH ASSEMBLY WITH COMBINED LIGHT AND LIGHT SHIELD

BACKGROUND OF THE INVENTION

This invention relates to an illuminated switch assembly of the type having a display panel with a first area of graphic indicia illuminated to display the function of the switch and a second area illuminated to provide an indication that the function is activated.

Pushbutton switches, such as the type found in automobiles, are sometimes required to be backlit. This is for low light viewing of the graphic indicia on the face of the pushbutton which illustrates the function associated with the switch. In some instances, it may also be required to indicate that the function has been activated by means of an indicator light on this same surface. For aesthetic reasons, it is undesirable to have the "on" indicator interferingly backlit by the light source for the graphics, or vice versa. This is especially true when the two light sources are different in color. It is therefore a primary object of the present invention to provide a cost effective means of stopping the transmission of light between different adjacent backlit areas on the same surface.

In the particular application with which the present invention is concerned, the light source for back-lighting the graphics area is an electroluminescent panel and the "on" indicator light source is either a miniature incandescent lamp or a light emitting diode. In this application, one possible solution to the light leakage problem is to position the indicator light source within an opaque shroud which is part of the button. With such an arrangement, the indicator light source could either move with the button or be stationary, having the button and shroud move relative to it. However, both of these alternatives present problems. Thus, if the indicator light source moves with the button, then the connection to a power source for the light source becomes difficult, since it may require additional parts, resulting in a higher cost. If, on the other hand, the light source does not move with the button, it must be mounted relatively close to the button. In many applications, this may not be possible due to size constraints placed upon the button and the graphics. In turn, this limits the wall thickness of the shroud in the button because the extension of the walls is dependent upon the thickness of the walls at the parting line of the plastic button mold, since the walls must be tapered to allow easy ejection from the mold. This limits how far the walls of the shroud can extend down around the indicator light source. In the particular application for which the present invention was developed, the light source is mounted so far from the button that the shroud walls cannot be made long enough to envelope the light source or sufficiently baffle the light. Another possible solution is to place a separate shroud around the indicator light source. However, this is disadvantageous since it would require an additional part, resulting in a higher cost. It is therefore another object of the present invention to overcome the aforementioned problems.

SUMMARY OF THE INVENTION

The foregoing, and additional, objects are attained in accordance with the principles of this invention by providing an illuminated switch assembly having a pushbutton with a graphics area backlit by an electroluminescent panel mounted on a first support surface to underly the graphics area. A separate indicator lamp is provided and is lit when the function selected by the switch assembly is activated. The indicator lamp illuminates a small window adjacent the graphics area. A wall is provided separating the graphics area from the window and extending toward the light sources. To prevent light from the indicator lamp from impinging upon the graphics area, a coating of opaque material is provided on the underside of the electroluminescent panel. This coating extends a sufficient distance away from the indicator lamp that light from the lamp cannot leak through the electroluminscent panel.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
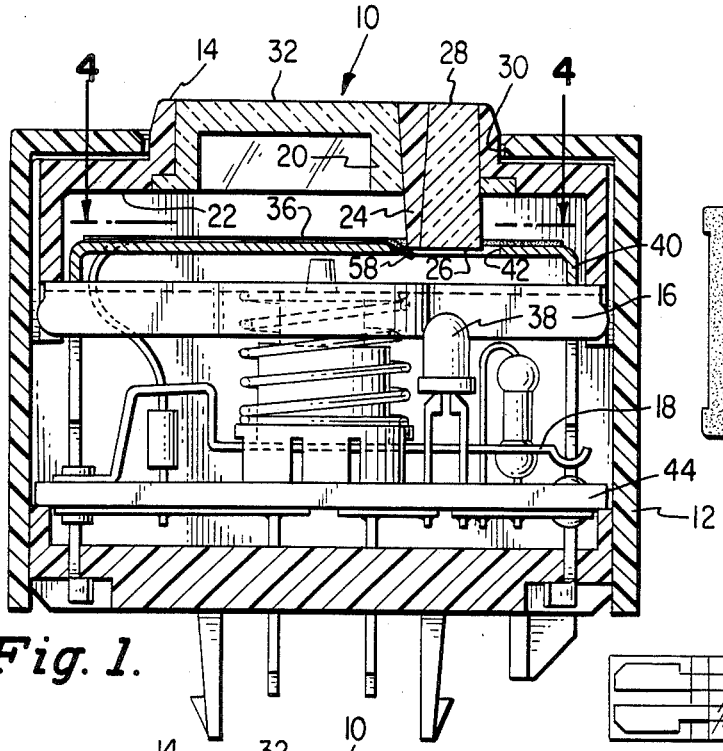
FIG. 1 is a cross sectional view of a switch assembly in which the present invention is incorporated.

Referring now to the drawings, shown therein is a switch assembly, designated generally by the reference numeral 10, contained within a case 12. The assembly 10 includes a pushbutton actuator 14 mounted so as to cooperate with the actuator bar 16 to control the position of the switch blade 18. The details of construction of the switch, and its manner of operation, do not form a part of the present invention.

Illustratively, the pushbutton 14 is a two-shot molded button, the construction of which involves a molded clear acrylic insert 20 with a black ABS portion 22 molded around it. It is also includes an integrally molded wall 24 and light pipe 26. The light pipe 26 forms a window 28 at its outer extremity on the surface of the pushbutton 14.

Figure 3:
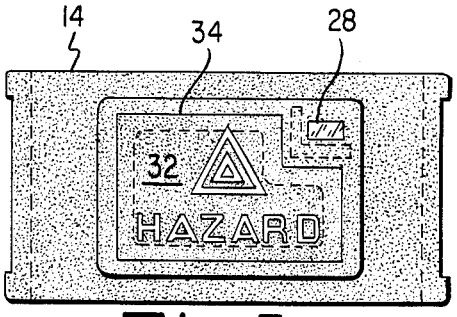
FIG. 3 is a top plan view of an illustrative actuator button which may be utilized in the construction shown in FIGS. 1 and 2.
Figure 4:
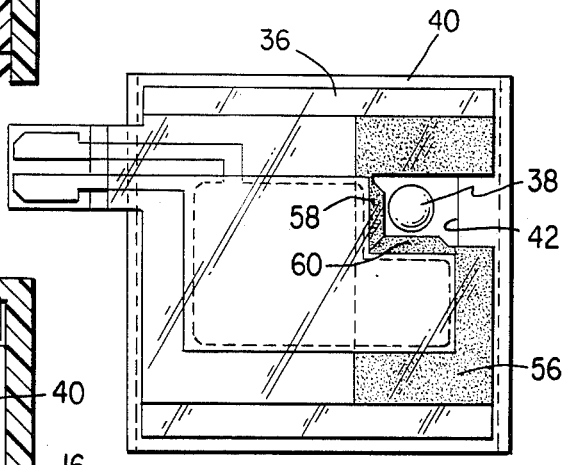
FIG. 4 is a view taken substantially along the line 4—4 in FIG. 1.

As is clearly shown in FIG. 3, the portion of the pushbutton 14 which extends through the opening 30 in the case 12 forms a display panel with a generally planar display surface 32. The display surface 32 has a first region 34 of graphic indicia indicating the function controlled by the switch assembly 10. Thus, the surface 32 is coated with an opaque material except in areas forming a graphic pattern, so that when it is backlit the graphic pattern is illuminated. For example, in an automobile, the switch assembly 10 may provide the function of activating the hazard light flashing system and, accordingly, as illustrated in FIG. 3, the graphic display region 34 has indicia to that effect. The display surface 32 also includes a second region for indicating when the function associated with the switch assembly 10 is activated. This second region includes the window 28. As will be described hereinafter, the switch assembly 10 includes a first source for illuminating the first region 34 to display the function and a second source for illuminating the window 28 when the function is activated. These sources are within the case 12 on the side of the pushbutton 14 away from the operator.

Figure 2:
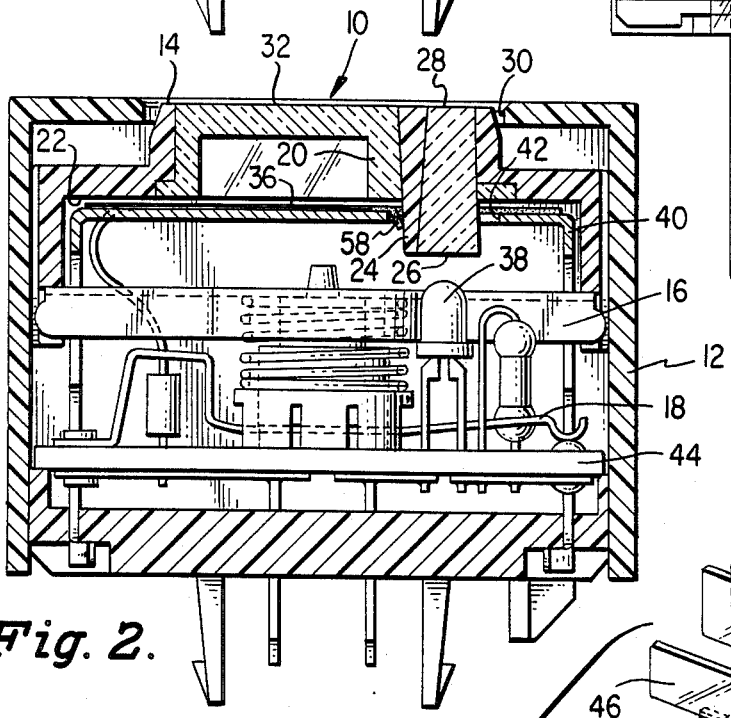
FIG. 2 is a view similar to FIG. 1 showing the switch assembly with the actuator button depressed.
Figure 5:
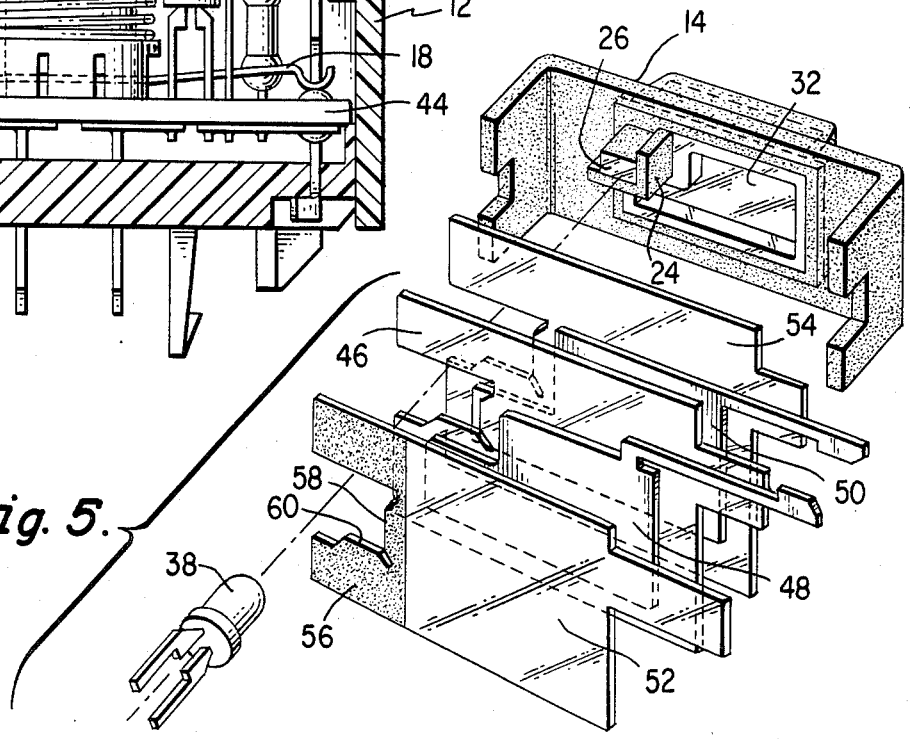
FIG. 5 is an exploded perspective view of the actuator button and the illumination sources of the assembly shown in FIGS. 1 and 2.

An electroluminescent panel 36 is provided to illuminate the graphics region 34 and a lamp 38 is provided to illuminate the window 28. To support the electroluminescent panel 36, there is provided a first support surface 40 which underlies the pushbutton 14 in close proximity to the display surface 32. The support surface 40 is formed with an opening 42 to allow the wall 24 to extend therethrough when the pushbutton 14 is depressed, as shown in FIG. 2. Thus, the opening 42 is aligned with the window 28. The lamp 38 is mounted on a support surface 44, illustratively a printed circuit board, in underlying relationship to the opening 42 so that when lit, its light passes through the light pipe 26 to illuminate the window 28.

The electroluminescent panel 36 is conventionally formed as a sandwich of areas of electroluminescent phosphor material 46 and electrical conductors 48 and 50 sandwiched between supporting transparent layers 52 and 54 of mylar material. The phosphor material 46 underlies the graphics region 34 but not the window 28.

In order to shield the graphics region 34 from the lamp 38, an opaque coating 56 is provided on a portion of the lower mylar layer 52. It is preferable that only a portion of the layer 52 is provided with the opaque coating 56. This is because if the entire layer 52 was formed of an opaque material, colorant in the mylar can adversely affect the dielectric properties of the electroluminescent material, which affects the life of the lamp. Further, if the opaque material were coated over the entire surface of the layer 52, or if the layer 52 were to be opaque, this would interfere with proper registration of the layers of the electroluminescent panel 36 during its manufacture.

As a further aid in shielding the graphics region 34 from the lamp 38, flaps 58 and 60 formed from the coated layer 52 extend into the opening 42. The flaps 58 and 60 preferably interfere with the wall 24, as may be seen from FIGS. 1 and 2, but since the flaps 58 and 60 flex at the edge of the opening 42, this does not create a problem.

Accordingly, there has been disclosed an improved illuminated switch assembly. It is understood that the above-described embodiment is merely illustrative of the application of the principles of this invention. Numerous other embodiments may be devised by those skilled in the art without departing from the spirit and scope of this invention, as defined by the appended claims.

I claim:

1. An illuminated switch assembly comprising:

a switch;

a switch actuator operative upon movement by an operator to activate said switch with a display panel having a generally planar display surface, the display surface having a first region of graphic indicia adapted to be illuminated by a first source from one side thereof away from the operator to display the function controlled by the switch and a second region adapted to be illuminated by a second source from said one side away from the operator to indicate actuation of said switch, said actuator being formed with a wall separating said first and second regions and extending away from the display surface in a direction substantially transverse thereto;

means defining a first support surface underlying said display panel in close proximity to said display surface, said first support surface being formed with an opening to allow said wall to extend therethrough;

an electroluminescent panel mounted on said first support surface underlying said first region but not said second region of said display surface and operative as said first source of illumination, said electroluminescent panel being formed as a sandwich comprising plural layers with a layer having areas of electroluminescent phosphor and electrical conductors thereon and disposed between supporting transparant layers;

means defining a second support surface underlying said first support surface;

a lamp mounted on said second support surface and disposed to underly the opening of said first support surface and operative as said second source of illumination; and, shield means operative to prevent said lamp from illuminating said first region and including a coating of opaque material on the layer of said electroluminescent panel adjacent said first support surface and adjacent said opening, said opaque material extending along said layer a sufficient distance such that light from said lamp cannot leak through the coated layer to said first region of graphic indicia.

2. The assembly according to claim 1 wherein said shield means further includes a flap formed from the coated layer and extending into said opening.

* * * * *